US007144352B2

(12) United States Patent
Hazan

(10) Patent No.: US 7,144,352 B2
(45) Date of Patent: Dec. 5, 2006

(54) EXERCISING DEVICE FOR ABDOMINAL MUSCLES

(76) Inventor: Haim Hazan, 312/12 Zvi Borenstein Street, Yerucham, 80500 (IL)

( * ) Notice: Subject to any disclaimer, the term of this patent is extended or adjusted under 35 U.S.C. 154(b) by 0 days.

(21) Appl. No.: 10/516,332

(22) PCT Filed: Apr. 28, 2003

(86) PCT No.: PCT/IL03/00341

§ 371 (c)(1),
(2), (4) Date: Nov. 30, 2004

(87) PCT Pub. No.: WO03/097176

PCT Pub. Date: Nov. 27, 2003

(65) Prior Publication Data

US 2005/0227835 A1 Oct. 13, 2005

(30) Foreign Application Priority Data

May 15, 2002 (IL) ..... 149678

(51) Int. Cl.
*A63B 26/00* (2006.01)
*A63B 71/00* (2006.01)

(52) U.S. Cl. ..... 482/141; 482/126

(58) Field of Classification Search ..... 482/142, 482/140, 126–130, 62; D21/665, 692
See application file for complete search history.

(56) References Cited

U.S. PATENT DOCUMENTS

| | | | | |
|---|---|---|---|---|
| 1,548,849 | A * | 8/1925 | Ruden | 482/128 |
| 5,176,622 | A * | 1/1993 | Anderson et al. | 602/19 |
| 5,224,914 | A * | 7/1993 | Friedman | 482/127 |
| 5,421,800 | A * | 6/1995 | Mullen | 482/121 |
| 6,387,024 | B1 * | 5/2002 | Monti et al. | 482/142 |
| 2002/0068884 | A1 * | 6/2002 | Alviso | 601/1 |

* cited by examiner

*Primary Examiner*—Lori Amerson
(74) *Attorney, Agent, or Firm*—Fulbright & Jaworski L.L.P.

(57) ABSTRACT

The invention provides a free-standing portable exercise device (10) for executing push-ups in an inclined standing position and for simultaneously exercising the abdominal muscles of the user, the device (10) having a base (12), two elevated spaced-apart handles (22) supported by a structure above the base (16), and a spring-biased pad (18) supported by the structure and being positioned between the handles (22) to be contacted by the abdomen of an exercising user, the pad (18) being spring-loaded upwards and moving in an angular forward-downward direction when pressed upon by the abdomen of an exercising user.

12 Claims, 3 Drawing Sheets

EXERCISING DEVICE FOR ABDOMINAL MUSCLES

The present invention relates to exercising devices.

More particularly, the invention provides a portable exercising device whereby a user can execute push-ups without excessive exertion, the device being used to exercise and to strengthen the stomach muscles.

As is well known, particularly to those who have undergone military training, push-ups with the body substantially horizontal can be done by those in good physical condition without any equipment whatsoever. The middle-aged, the obese and those not in best physical condition would also benefit from exercise of this type, if it were possible to do so at a suitable lower level of exertion. There is therefor a need for an exercise device, which strengthens the abdominal muscles but does not require the strength and degree of effort required by normal push-ups when the body is near horizontal and is supported by the feet and arms of the exerciser.

Abdominal exercisers are have been known for many decades, but have not seen the widespread use of treadmills, rowing-type devices stair climbers and other exercise machines, possibly because prior-art machines do not match the requirements of potential users.

The state, of the art can be gauged by the following review of relevant U.S. patents.

In U.S. Pat. No. 3,228,392 Speyer discloses a spring-loaded abdominal exerciser. The device does not provide for handgrips, and is presumably intended for use while the exercising person is in a horizontal position.

U.S. Pat. No. 4,923,194 (expired) to Montgomery provides a sloping frame on which a slidably mounted cross bar provides handgrips. No stomach support is included.

Van Der Hoeven discloses a portable abdominal exerciser in U.S. Pat. No. 5,005,832. The device can be used while sitting, develops the arm muscles but does not exercise the leg muscles. The inventor further develops the apparatus as disclosed in U.S. Pat. No. 5,160,304. In FIG. 8, the device is developed for use by a sitting person, but the type of exercise provided is not equivalent to push-ups exercise.

An apparatus, which does provide exercise equivalent to push-ups, is disclosed by Westmoreland et al., in U.S. Pat. No. 5,330,408. The apparatus is however designed for use with the user in a horizontal position and able to exert a force to bring the provided handgrips closer together. The apparatus is not portable.

Catering to those of more modest physical ability is the device disclosed by Mullen in U.S. Pat. No. 5,421,800. However the user thereof must position his body horizontally, and does not allow for exercising in an inclined standing position which is more suitable for those with less athletic capability. In U.S. Pat. No. 5,820,535 Van Der Hoeven et al. disclose a pad claimed to contact a large area of the abdomen. The pad is to be used in combination with a prior art exercise apparatus.

Formanek discloses a C-shaped bar in U.S. Pat. No. 6,048,294 which is intended to be hand gripped by an exercising person while doing push-ups. The bar may be freestanding, on its own support stand, or connected to a prior art exercise framework.

Tu discloses an exerciser for arms and abdomen in U.S. Pat. No. 6,053,851. The device is not used for push-ups.

The exercise apparatus disclosed by Tomabene in U.S. Pat. No. 6,283,900 B1 lifts the user off the ground in response to pressure on the backrest for exercising three muscle groups. This device also is not used for push-ups. A portable, lap-based exercising device is disclosed by Boland in U.S. Pat. No. 6,296,598. Various exercises may be carried out while the user is sitting on a chair unconnected to the device. Also this device is not used for push-ups.

It is therefore one of the objects of the present invention to obviate the disadvantages of prior art exerciser devices and to provide an apparatus which can be used for doing push-ups while the body is in an inclined position.

It is a further object of the present invention to provide an adjustable device wherein, by setting the height of the device, the body angle of a user can be set. An angle nearer horizontal is suitable for those in good physical condition, and a nearer vertical angle is more suitable for those desiring less exertion.

The present invention achieves the above objects by providing a free-standing portable exercise device for executing push-ups in an inclined standing position and for simultaneously exercising the abdominal muscles of the user. The device has a base, two elevated spaced-apart handles supported by a structure above the base, and a spring-biased pad supported by the structure and being positioned between the handles to be contacted by the abdomen of an exercising user. The pad is spring-loaded upwards and moves in an angular forward-downward direction when pressed upon by the abdomen of an exercising user.

In a preferred embodiment of the present invention there is provided an exercise device wherein the pad is pivotally supported so that when contacted by the body of a user the outer major face of the pad assumes a plane substantially parallel to and in contact with the abdominal area of the user.

As will be realized, while the user is executing the push-ups with the device of the present invention, the abdomen repeatedly comes in contact with the pad and automatically tenses, thereby resulting in automatic repeated tensing of the abdominal muscles. In advanced models wherein the spring loading of the pad is increased the user will also use his abdominal muscles to consciously push against the resistance of the spring.

In a most preferred embodiment of the present invention there is provided an exercise device wherein upward spring loading is provided by two spaced-apart leaf springs each rigidly gripped at a lower extremity thereof by a structural component of the device. Additional leaf springs are provided and can selectively be inserted into and retained by a holding device attached to the structural component, to contact and stiffen the existing leaf spring(s).

Yet further embodiments of the invention will be described hereinafter.

It will thus be realized that the novel device of the present invention the degree of abdominal pressure can also be readily adjusted, by inserting or removing additional leaf springs. The height of the device determines the body angle of the user. Height adjustment is provided, so that the device can be set lower for more athletic users and higher for less strenuous exercise.

The frame of the device described can suitably be made of metal tubing assembled by screws, which are removed when the device is to be stored or transported.

Where a fixed frame is acceptable, the tubing is welded at the joints to provide additional rigidity.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
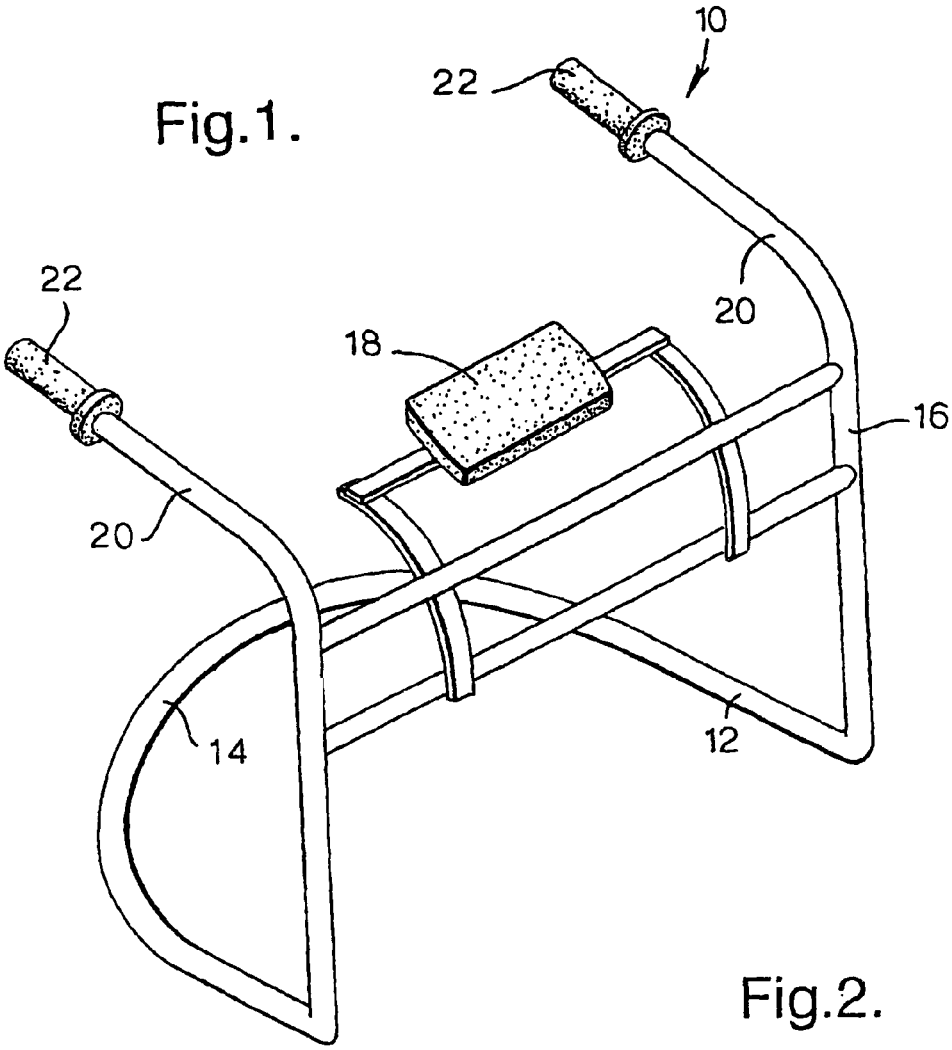
FIG. 1 is a perspective view of a preferred embodiment of the exercising device according to the invention.

There is seen in FIG. 1 a freestanding portable exercise device 10 for executing push-ups in an inclined standing position. Simultaneously the abdominal muscles of the user are exercised.

The shown device 10 has a base 12 that is of U form, the bottom 14 of the U pointing forwards.

A structure 16 is supported above the base 12 and in turn supports a central spring-biased pad 18.

Two arms 20 of the structure 16 terminate in a pair of handles 22 to be gripped by the user, the handles 22 being disposed at a height proximate to the height of the pad 18. The pad 18 is positioned between the handles 22, and is contacted by the abdomen of an exercising user. The pad is spring-loaded upwards-backwards and moves in an arcuate forward downward direction when pressed upon by the abdomen of an exercising user, standing in a forwardly inclined manner.

With regard to the rest of the figures, similar reference numerals have been used to identify similar parts.

Figure 2:
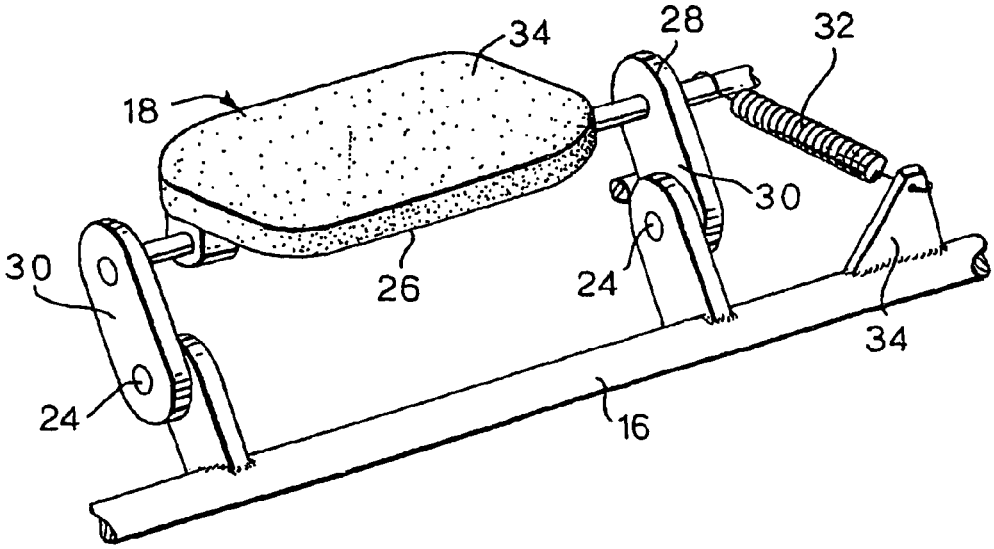
FIG. 2 is a perspective view of an embodiment equipped with a tension spring to provide resistance.

Referring now to FIG. 2, there is seen a detail of an embodiment, wherein the pad 18 is pivotally supported at an axis parallel to its major axis of the pad 18 and proximate to the lower surface 26 thereof.

A circular section beam member 28 serves as the pivot supporting the pad 18. The beam member 28 is provided with two dependent arms 30 which are hinged to the structure 16 at a pivot point 24.

In the present embodiment spring loading is provided by a coil tension spring 32 anchored at a dependent arm 30 and at a lug 34 attached to the structure 16.

When contacted by the body of a user the outer major face 34 of the pad 18 assumes a plane substantially parallel to and in contact with the abdominal area of the user.

Figure 3:
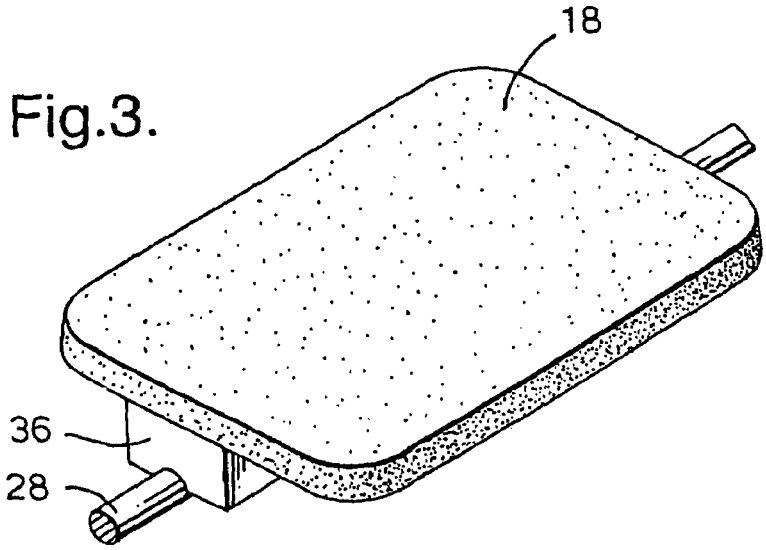
FIG. 3 is a perspective detail view of a removable pad.

FIG. 3 illustrates a detail of an exercise device wherein the pivotally supported pad 18 can be readily removed from the circular section beam member 28 to which it is attached. The pad 18 is clipped and retained on the beam 28 by means of attachment holders 36 which envelope slightly over 50% of the beam circumference. During assembly or removal of the pad 18, the attachment holders 36 yield slightly to allow passage of the beam 28. The pad 18 can thus be readily replaced thereon without the use of tools.

Figure 4:
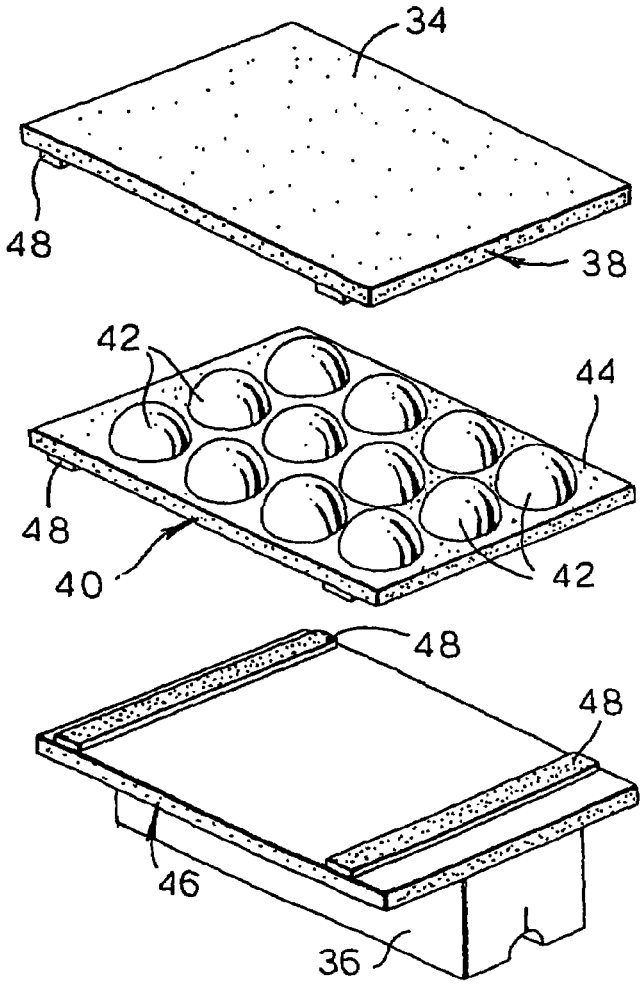
FIG. 4 is an exploded view of alternative pads, which can be used on the device.

Seen in FIG. 4 is a detail of the exercise device wherein a plurality of abdominal contacting pads are provided.

A first basically smooth pad 38 has a padded upper face 34.

A second, alternative pad 40 is provided with an array of dome-like projections 42 on its outer major face 44.

In the present embodiment the pad is composed of a base member 46 and an upper member 38, 40. Connection between the upper member 38, 40 and the base member 46 is by means of VELCRO® strips 48.

Figure 5:
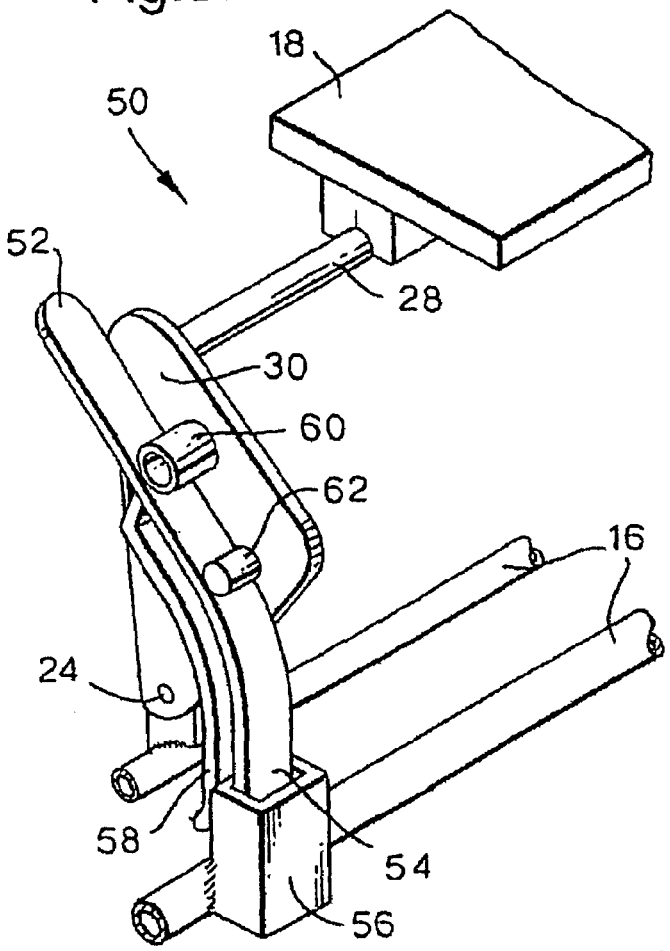
FIG. 5 is a perspective detail view of an embodiment using leaf springs.

Referring now to FIG. 5, there is depicted a detail of a further embodiment 50 of the exercise device.

Spring loading is provided by a pair of spaced-apart leaf springs 52, only one of which is seen in the figure. The springs 52 are rigidly supported at their lower extremity 54 by a structural pocket 56 of the device.

Additional leaf springs 58 are provided and can selectively be inserted into the pocket 56. The additional springs 58 contact and stiffen the existing leaf spring(s) 52.

The two dependent arms 30 are each equipped with a roller 60 which transfers pressure from the pad 18 to the leaf springs 52. One of the arms 30 further rigidly supports a stop pin element 62, which presses on the upper face of the leaf spring 52 when the pad 18 is released. The stop pin 62 limits the return movement of the pad 18 and thus maintains the springs 52 in a pre-loaded state. Consequently the pad 18 does not move before substantial abdominal pressure has been applied thereto.

Figure 6:
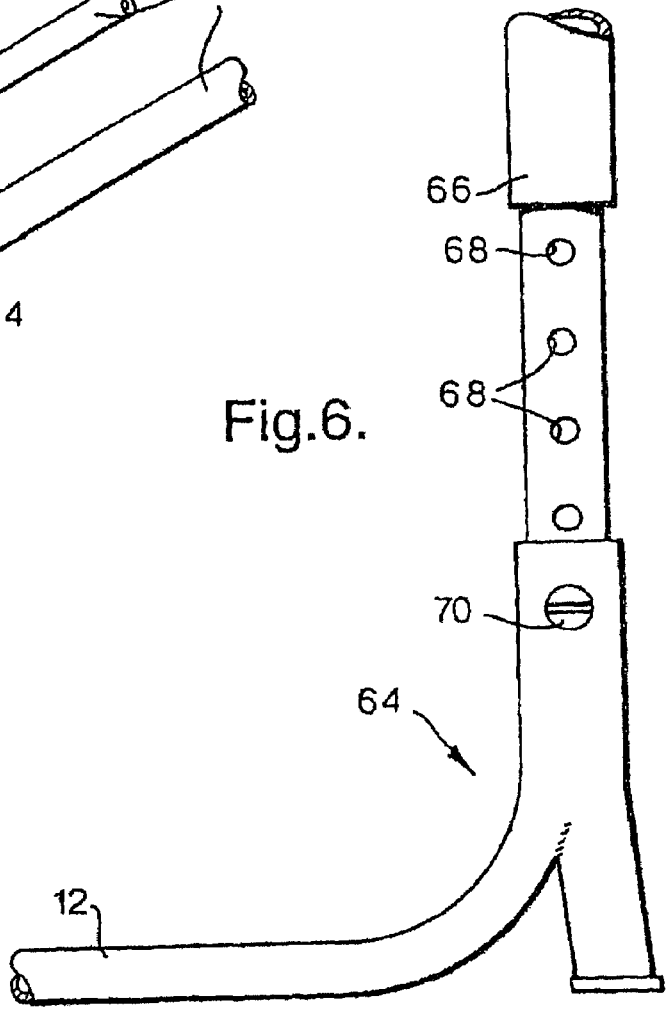
FIG. 6 is a perspective view of a height-adjustment arrangement for the device.

FIG. 6 shows a detail of exercise device 64, wherein the structure 66 is provided with height-adjusting means.

The height of the structure 66 determines the body angle of the user.

By use of alternate apertures 68 provided for the screw fasteners 70 the structure 66 can be set at a lower level for more athletic users and at a higher level to provide less strenuous exercise. Several intermediate settings are also available.

It will be realized that instead of using a pair of spaced apart springs to bias pad 18, a central spring or resilient plastic spring element (not shown) can be provided.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A free-standing portable exercise device for executing push-ups in an inclined standing position and for simultaneously exercising the abdominal muscles of the user, the device comprising:

a tubular base;

two elevated substantially stationary spaced-apart handles supported by a structure above and connected to said base;

an upwardly spring-biased pad having an outer major face supported by said structure and being positioned between said handles at an axis parallel to its major axis and proximate to a lower surface;

means for pivotally supporting said pad on said structure;

said pad sized and configured to directly engage the abdomen of an exercising user with said major face maintaining a position in a plane substantially parallel to the abdominal area of said exercising user executing push-ups in an inclined standing position;

whereby said upwardly spring-biased pad moves in an arcuate forward-downward direction when engaged and pressed upon by the abdomen of an exercising user white said base and said handles remain substantially stationary to support the user in variable inclined standing positions.

2. An exercise device according to claim 1, wherein said pivotally supported spring-biased pad is removably detachable.

3. An exercise device according to claim 2, further comprising a plurality of interchangeable abdominal contacting pads including one pad having a smooth top surface and a second alternative pad having an array of projections on said outer major face.

4. An exercise device according to claim 1, wherein said spring-biased pad includes at least one leaf spring rigidly mounted at a lower extremity by a structural pocket of said device.

5. An exercise device according to claim 4, wherein said spring biased pad includes two spaced-apart leaf springs rigidly mounted at a lower extremity thereof by a structural pocket of said device.

6. An exercise device according to claim 5, wherein additional leaf springs are provided and can selectively be inserted into and retained by a holding device attached to said structural component, to contact and stiffen the existing leaf spring(s).

7. An exercise device according to claim 1, which further includes means for adjusting the height of the handles relative to the base.

8. A free-standing portable exercise device for executing push-ups in an inclined standing position and for simultaneously exercising the abdominal muscles of the user, the device comprising:

a base;

two elevated substantially stationary spaced-apart handles supported by a structure above said base;

an upwardly spring-biased pad supported by said structure and being positioned between said handles at an axis parallel to its major axis and proximate to a lower surface; said pad sized and configured to directly engage the abdomen of an exercising user; said pad further being pivotally supported by a circular section beam member where said beam member includes two dependent arms hinged to said structure at a pivot point; whereby when said spring-biased pad moves in an arcuate forward-downward direction when engaged and pressed upon by the abdomen of an exercising user while said base and said handles remain substantially stationary to support the user in variable inclined standing positions; said pad further having an outer major face and being pivotally supported relative to said structure such that when contacted by the body of a user executing push-ups in an inclined standing position, said outer major face of said pad maintains a position in a plane substantially parallel to and in contact with the abdominal area of the user.

9. An exercise device according to claim 8, wherein said pivotally supported spring-biased pad is removably detachable.

10. An exercise device according to claim 9, further comprising a plurality of interchangeable abdominal contacting pads including one pad having a smooth top surface and a second alternative pad having an array of projections on said outer major face.

11. An exercise device according to claim 8, wherein said spring-biased pad includes at least one leaf spring rigidly mounted at a lower extremity by a structural pocket of said device.

12. An exercise device according to claim 11, wherein said upward bias of said spring biased pad includes two spaced-apart leaf springs rigidly mounted at a lower extremity thereof by a structural pocket of said device.

* * * * *